US012435607B2

(12) United States Patent
Rodriguez et al.

(10) Patent No.: US 12,435,607 B2
(45) Date of Patent: Oct. 7, 2025

(54) PRODUCTION INLET ASSEMBLIES FOR A SUBTERRANEAN WELLBORE

(71) Applicant: EOG Resources, Inc., Houston, TX (US)

(72) Inventors: Nathan Rodriguez, Denver, CO (US); Geoffrey Steiner, Castle Rock, CO (US)

(73) Assignee: EOG Resources, Inc., Houston, TX (US)

( * ) Notice: Subject to any disclaimer, the term of this patent is extended or adjusted under 35 U.S.C. 154(b) by 139 days.

(21) Appl. No.: 18/233,227

(22) Filed: Aug. 11, 2023

(65) Prior Publication Data

US 2024/0052733 A1 Feb. 15, 2024

Related U.S. Application Data

(60) Provisional application No. 63/397,003, filed on Aug. 11, 2022.

(51) Int. Cl.

| | |
|---|---|
| ***E21B 43/12*** | (2006.01) |
| ***E21B 17/07*** | (2006.01) |
| ***E21B 43/34*** | (2006.01) |
| ***E21B 47/092*** | (2012.01) |

(52) U.S. Cl.

CPC ..... *E21B 43/126* (2013.01); *E21B 17/07* (2013.01); *E21B 43/35* (2020.05); *E21B 47/092* (2020.05)

(58) Field of Classification Search

CPC ..... E21B 43/126; E21B 17/07; E21B 43/38; E21B 47/092; E21B 43/35; E21B 43/02; E21B 37/08; E21B 21/002

See application file for complete search history.

(56) References Cited

U.S. PATENT DOCUMENTS

| | | | | |
|---|---|---|---|---|
| 4,856,756 A * | 8/1989 | Combs | F16K 3/26 166/332.6 |
| 5,018,581 A * | 5/1991 | Hall | E21B 34/12 166/373 |
| 2010/0236787 A1* | 9/2010 | Hall | E21B 17/07 166/243 |

* cited by examiner

*Primary Examiner* — Yong-Suk (Philip) Ro

(74) *Attorney, Agent, or Firm* — Conley Rose, P.C.

(57) ABSTRACT

A production inlet assembly for use within a subterranean wellbore. The production inlet assembly includes a landing sub that affixable within the wellbore, and a sand catcher including a chamber that is configured to receive particulates separated from formation fluids that enter the production inlet assembly. The production inlet assembly also includes a telescoping joint coupled between the landing sub and the sand catcher that is permitted to translate axially along the landing sub.

19 Claims, 5 Drawing Sheets

PRODUCTION INLET ASSEMBLIES FOR A SUBTERRANEAN WELLBORE

CROSS-REFERENCE TO RELATED APPLICATIONS

This application claims benefit of U.S. provisional patent application Ser. No. 63/397,003 filed Aug. 11, 2022, and entitled "Production Inlet Assemblies for a Subterranean Wellbore," which is hereby incorporated herein by reference in its entirety for all purposes.

STATEMENT REGARDING FEDERALLY SPONSORED RESEARCH OR DEVELOPMENT

Not applicable.

BACKGROUND

A wellbore may be used to access deposits of minerals or other resources that are trapped within a subterranean formation. For instance, hydrocarbon oil and gas or water may be produced to the surface via a wellbore that is drilled into the subterranean formation from the surface. In some cases, particulates such as sand or silt may be produced into the wellbore along with the oil, gas, water, etc. Eventually the produced particulates may fill or substantially fill the wellbore so that further production is restricted or prevented altogether.

BRIEF SUMMARY

An embodiment of a production inlet assembly for use within a subterranean wellbore, the wellbore including a central axis and the production inlet assembly comprises landing sub that affixable within the wellbore, a sand catcher including a chamber that is configured to receive particulates separated from formation fluids that enter the production inlet assembly, and a telescoping joint coupled between the landing sub and the sand catcher, wherein the telescoping joint is permitted to translate axially along the landing sub. In some embodiments, the production inlet assembly comprises a biasing member coupled between the landing sub and the telescoping joint, wherein the biasing member biases the telescoping joint axially uphole relative to the landing sub. In some embodiments, the telescoping joint comprises a body, a cap positioned at an upper end of the body, and a cavity defined within the body extending axially from a lower end of the body to the cap, wherein the landing sub includes a cylindrical member that extends axially through a port in the cap. In certain embodiments, the landing sub includes an annular shoulder positioned within the cavity, and wherein the biasing member is positioned axially between the cap and the shoulder within the cavity. In certain embodiments, the biasing member comprises a compressible foam. In some embodiments, the production inlet assembly comprises a marker antenna coupled to the telescoping joint so that the marker antenna is configured to translate with the telescoping joint relative to the landing sub, wherein the marker antenna extends axially uphole of the telescoping joint. In some embodiments, the marker antenna comprises a ferromagnetic material.

An embodiment of a method for performing a workover operation for a subterranean wellbore comprises (a) removing a pumping system from the wellbore, (b) detecting a depth of a telescoping joint of a production inlet assembly installed within the wellbore after (a), wherein the production inlet assembly comprises a landing sub that is fixed within the wellbore, and a sand catcher including a chamber that is configured to receive particulates separated from formation fluids that enter the production inlet assembly, wherein the telescoping joint is coupled between the landing sub and the sand catcher and is permitted to translate axially along the landing sub, and (c) determining a fill level of particulates within the chamber of the sand catcher based on the detected depth. In certain embodiments, the production inlet assembly comprises a marker antenna extending axially uphole of the telescoping joint, and wherein (c) comprises detecting a depth of the marker antenna. In certain embodiments, the marker antenna comprises a ferromagnetic material, and wherein (c) comprises detecting the ferromagnetic material of the marker antenna with a downhole detection device. In some embodiments, the downhole detection device comprises a casing collar locator. In some embodiments, the method comprises detecting an initial depth of the telescoping joint before (b), wherein (d) comprises determining a fill level of the particulates within the chamber based on a difference between the depth detected at (b) and the initial depth.

An embodiment of a production system for a subterranean wellbore comprises a pumping system comprising a downhole pumping assembly positioned within the wellbore, and a production inlet assembly coupled to downhole pumping assembly, the production inlet assembly comprising a landing sub that is configured to be fixed within the wellbore, an inlet sub including a port, an upper end, and a lower end, a sand catcher coupled to the lower end of the inlet sub, wherein the sand catcher includes a chamber that is fluidly coupled to the port, and a telescoping joint coupled between the landing sub and the upper end of the inlet sub, wherein the telescoping joint is permitted to translate axially along the landing sub. In certain embodiments, the landing sub comprises a throughbore, and a landing structure positioned within the throughbore, wherein the downhole pumping assembly is engaged with the landing structure. In certain embodiments, the inlet production assembly comprises a biasing member coupled between the landing sub and the telescoping joint, wherein the biasing member biases the telescoping joint axially uphole relative to the landing sub. In some embodiments, the telescoping joint comprises a body, a cap positioned at an upper end of the body, and a cavity defined within the body extending axially from a lower end of the body to the cap, wherein the landing sub extends axially through a port in the cap. In some embodiments, the landing sub includes an annular shoulder positioned within the cavity, and wherein the biasing member is positioned axially between the cap and the shoulder within the cavity. In certain embodiments, the biasing member comprises a compressible foam. In certain embodiments, the inlet production assembly comprises a marker antenna coupled to the telescoping joint so that the marker antenna is configured to translate with the telescoping joint relative to the landing sub, wherein the marker antenna extends axially uphole of the cap. In some embodiments, the marker antenna comprises a ferromagnetic material.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
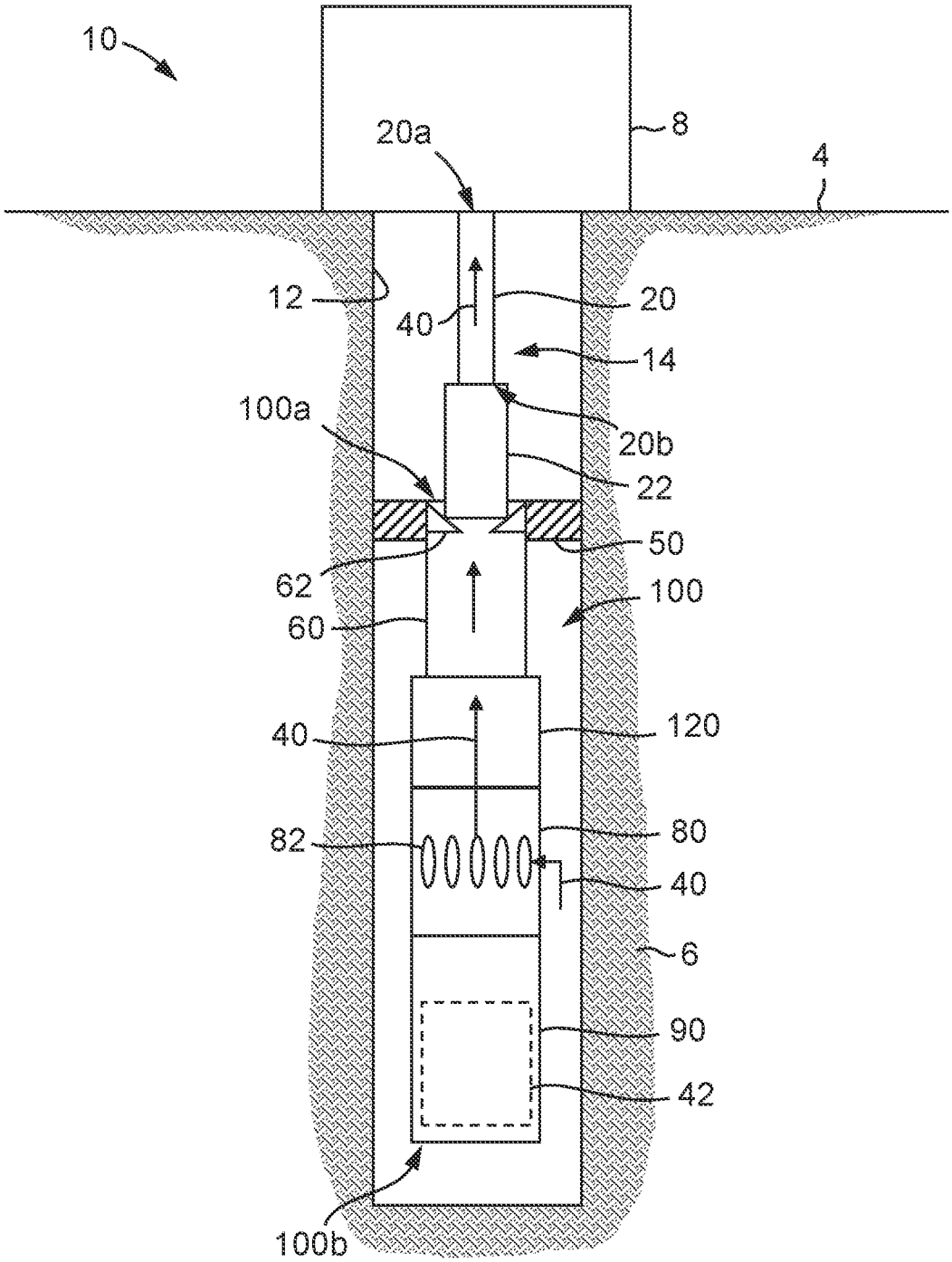
FIG. 1 is a schematic diagram of a production system installed within a subterranean wellbore according to some embodiments.

Particulates that are produced into a wellbore from a subterranean formation may fill the wellbore and thereby restrict or prevent further production of desired resources (e.g., hydrocarbon oil, hydrocarbon gas, water, etc.) via the wellbore. In addition, production of the particulates back to the surface may cause plugging and/or damage (e.g., erosion) of equipment both in and out of the wellbore.

As used herein, the term "particulates" refers to solid matter that may be produced from a subterranean wellbore along with formation fluids. The term "particulates" includes, but is not limited to, sand, silt, and other sediment or rock particles. In addition, as used herein, the term "formation fluids" refers to fluids (liquids, gases, multiphase fluids) that are produced from a subterranean formation via a wellbore. The term "formation fluids" includes, but is not limited to hydrocarbon liquids (e.g., oil, condensate), hydrocarbon gases, and water. Such formation fluids may also include minerals or other elements dissolved or suspended therein.

Systems may be installed within a wellbore to separate particulates from the flow of desired resources and then retain the separated particulates in a tank or other suitable enclosure to prevent the accumulated particulates from plugging the inlet flow paths into the wellbore from the subterranean formation. Such systems are typically referred to as "sand catcher" systems or more simply as "sand catchers." Periodically, a well operator may conduct a so-called workover operation to service, repair, and/or replace components of the wellbore. During these workover operations, a well operator may pull the sand catcher system from the wellbore so as to empty particulates captured therein. In many instances, the sand catcher system may not be full or sufficiently full to justify the costs (and time) associated with pulling these components to the surface. However, a well operator cannot assess the fill level or storage capacity of the sand catcher system without pulling it to the surface for inspection. Therefore, the costs of workover operations typically include the additional costs of pulling the sand catcher system to the surface, even if these operations are ultimately unnecessary (e.g., because the sand catcher system is not sufficiently full). In some cases, the costs of pulling the sand catcher system to the surface may account for a significant fraction of the total costs to perform the workover operation (e.g., up to about 50% of the total costs in some situations).

Accordingly, embodiments disclosed herein include production inlet assemblies which enable a well operator to determine a fill level of a downhole sand catcher without pulling the sand catcher to the surface. In some embodiments, the production inlet assemblies may include a telescoping joint coupled to a sand catcher system that allows the sand catcher to fall or sink within the wellbore as particulates accumulate therein. By determining the distance that the telescoping joint has axially translated into the wellbore (e.g., via a suitable downhole detection device), the wellbore operator may determine the fill level of the sand catcher in situ. Therefore, through use of the embodiments disclosed herein, a wellbore operator may avoid the unnecessary expense of pulling an insufficiently full sand catcher system to the surface during a workover operation.

Referring initially to FIG. 1, a production system 10 for producing formation fluids from a wellbore 12 extending into a subterranean formation 6 from the surface 4 is shown. In this exemplary embodiment, production system 10 generally includes a production inlet assembly 100 and a pumping system 14 fluidically coupled to the production inlet assembly 100.

In this exemplary embodiment, pumping system 14 includes a surface pumping assembly 8 positioned on or at the surface 4, a downhole pumping assembly 22 positioned within the wellbore 12, and a production string 20 (e.g., a string of production tubing) coupled to and extending between the surface pumping assembly 8 and the downhole pumping assembly 22. The production string 20 includes a first or upper end 20*a* positioned at or near the surface 4, and a second or lower end 20*b* inserted within wellbore 12. Upper end 20*a* is coupled to surface pumping assembly 8, and lower end 20*b* is coupled to downhole pumping assembly 22.

Production string 20 may comprise any suitable elongate tubular member or assembly. For instance, in some embodiments, production string 20 may comprise a plurality of tubular members (e.g., pipes) coupled end-to-end. In some embodiments, production string 20 may comprise a reel-able conduit such as coiled tubing and the like.

The surface pumping assembly 8 may comprise a beam pump, horsehead pump, or any other suitable surface pumping assembly. The downhole pumping assembly 22 may comprise a plunger assembly that is mechanically coupled to the surface pumping assembly 8 via a rod or other suitable linkage that may extend through the production string 20. During operations, the surface pumping assembly 8 may actuate the downhole pumping assembly 22 to draw formation fluids 40 out of the wellbore 12 via the production inlet assembly 100 and production string 20.

Production inlet assembly 100 is positioned within the wellbore 12 downhole of (e.g., upstream from) downhole pumping assembly 22. The production inlet assembly 100 includes a first or upper end 100*a*, and a second or lower end 100*b* opposite upper end 100*a*. In addition, in this exemplary embodiment, the production inlet assembly 100 generally includes a landing sub 60, a telescoping joint 120, an inlet sub 80, and a sand catcher 90. The landing sub 60 is positioned at the upper end 100*a*, the sand catcher 90 is positioned at the lower end 100*b*, the inlet sub 80 is positioned adjacent to and above the sand catcher 90, and the telescoping joint 120 is coupled between the landing sub 60 and the inlet sub 80. Thus, the telescoping joint 120 may also be said to be coupled between landing sub 60 and sand catcher 90 through via the inlet sub 80.

The landing sub 60 may be secured within the wellbore 12 via a fixing structure 50 which may comprise a plug or other suitable mechanism. Thus, the landing sub 60 may be positioned at a fixed depth within the wellbore 12. The downhole pumping assembly 22 is engaged with a landing structure 62 within the landing sub 60. In some embodiments, the landing structure 62 comprises a seating nipple. During operations, formation fluids 40 may be drawn into the production inlet assembly 100 via inlet ports 82 positioned on the inlet sub 80 (described in more detail below) and then through the production string 20 to the surface 4 via the downhole pumping assembly 22. Particulates 42 entrained within the formation fluids 40 flowing from formation 6 may be separated from the formation fluids 40 and directed into the sand catcher 90. As the number of particulates 42 within the sand catcher 90 increases, the telescoping joint 120 axially translates along landing sub 60 to allow the inlet sub 80 and sand catcher 90 to vertically sink or fall within the wellbore 12. The distance that the telescoping joint 120, inlet sub 80, and sand catcher 90 translate within the wellbore 12 may then be detected or determined (e.g., in the manner described herein) to enable an operator of wellbore 12 to determine the fill level of the sand catcher 90 while the sand catcher 90 is positioned within the wellbore 12. Further details of embodiments of the production inlet assembly 100 are described below.

Figure 2:
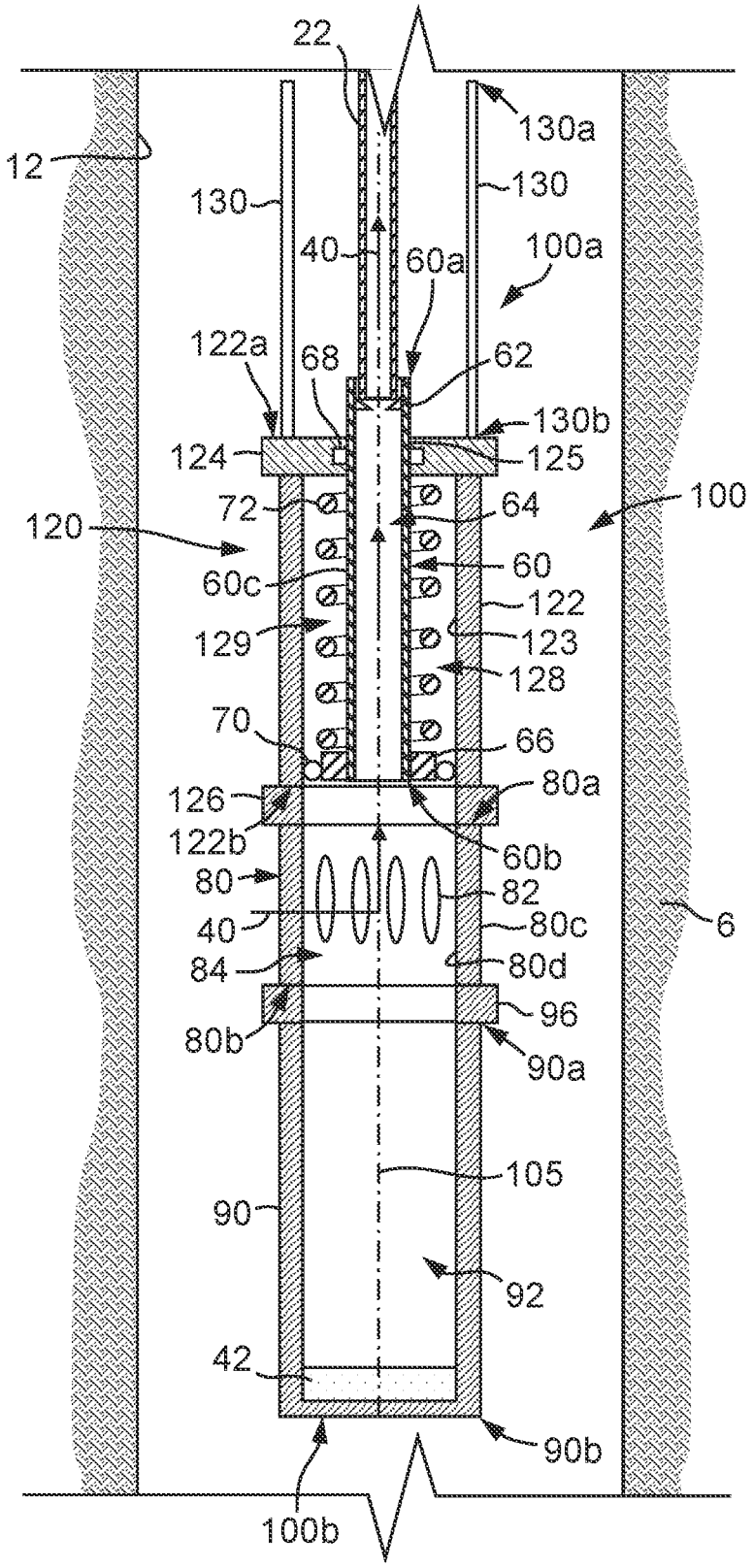
FIGS. 2 and 3 are side, cross-sectional views of a production inlet assembly of the production system of FIG. 1 according to some embodiments.

Referring now to FIG. 2, production inlet assembly 100 includes a central or longitudinal axis 105. Thus, the upper end 100*a* and lower end 100*b* are spaced from one another along axis 105.

In this exemplary embodiment, the landing sub 60 is a cylindrical member that includes a first or upper end 60*a*, a second or lower end 60*b* opposite upper end 60*a*, a radially outer surface 60*c* extends axially between ends 60*a*, 60*b*, and a throughbore 64 extending axially between ends 60*a*, 60*b* along axis 105. The landing structure 62 is positioned within the throughbore 64 and may be positioned axially closer to the upper end 60*a* than the lower end 60*b* along axis 105 in some embodiments. A radially extending annular shoulder 66 is positioned along radially outer surface 60*c* at or proximate to lower end 60*b* (e.g., the shoulder 66 may be axially closer to the lower end 60*b* than the upper end 60*a*).

In this exemplary embodiment, telescoping joint 120 includes a cylindrical housing 122 that has a first or upper end 122*a*, and a second or lower end 122*b* opposite upper end 122*a*. A cap 124 is positioned at the upper end 122*a*. A cavity 128 is defined within housing 122 that is formed by a radially inner surface 123. The cavity 128 extends axially from the lower end 122*b* to the cap 124. Cap 124 comprises a central bore 125 that extends axially therethrough. The landing sub 60 may extend through the bore 125 so that upper end 60*a* projects axially outwards from the cap 124 while the lower end 60*b* is positioned within cavity 128. A dynamic seal assembly 68 is positioned between the bore 125 and radially outer surface 60*c* of landing sub 60 so that fluid flow axially between the bore 125 and radially outer surface 60*c* is prevented or at least restricted. A dynamic seal assembly 70 is positioned radially between the shoulder 66 and the radially inner surface 123 of housing 122 so that an annular portion 129 of the cavity 128 that extends annularly about the radially outer surface 60*c* of inlet sub 80 and axially between shoulder 66 and cap 124 is sealed off from the other portions of production inlet assembly 100 and wellbore 12. The dynamic seal assemblies 68, 70 may comprise any suitable dynamic seal such as wiper seals, seal rings, etc.

In this exemplary embodiment, a biasing member 72 is positioned within the annular portion 129 of cavity 128 that engages with the cap 124 and the shoulder 66 so as to axially bias the shoulder 66 away from the cap 124 during operations. Because the landing sub 60 is fixed in position within the wellbore 12 as previously described, the biasing member 72 biases the telescoping joint 120 (particularly the housing 122) axially uphole relative to the landing sub 60 with respect to axis 105. In some embodiments, the biasing member 72 may comprise a coiled spring, however, biasing member 72 may comprise any suitable biasing member or assembly. For instance, in some embodiments, the biasing member 72 may comprise a compressible foam or gas that fills the annular portion 129 of cavity 128. In some embodiments, the biasing member 72 may comprise a hydraulic cylinder that is positioned with or formed by the annular portion 129. In some embodiments, the biasing member 72 may be configured to exert a sufficient biasing force on the cap 124 and shoulder 66 to balance or overcome the weight of the inlet sub 80 and sand catcher 90 when sand catcher 90 is empty. Thus, it should be appreciated that basing member 72 may comprise any suitable member or assembly that biases the cap 124 and shoulder 66 axially apart from one another during operations.

Inlet sub 80 is a cylindrical member having a first or upper end 80*a* and a second or lower end 80*b* opposite the upper end 80*a*. In addition, inlet sub 80 includes a radially outer surface 80*c* extending axially between ends 80*a*, 80*b*, and a radially inner surface 80*d* extending axially between ends 80*a*, 80*b*. The upper end 80*a* of inlet sub 80 is engaged with the lower end 122*b* of housing 122 of telescoping joint 120 via a coupling 126. In some embodiment coupling 126 may comprise a flange assembly, a threaded connection, or any other suitable coupling assembly.

In this exemplary embodiment, the inlet sub 80 includes a throughbore 84 extending between the ends 80*a*, 80*b* that is defined by the radially inner surface 80*d*. A plurality of inlet ports 82 extends radially between the radially outer surface 80*c* and the radially inner surface 80*d* to provide fluid communication between the environment within wellbore 12 and the throughbore 84. In some embodiments, inlet ports 82 comprise axially elongated slots; however, inlet ports 82 may have any suitable shape in other embodiments such as circular, square, triangular, rectangular, mesh, etc.

Referring still to FIG. 2, sand catcher 90 includes a first or upper end 90*a*, a second or lower end 90*b* opposite upper end 90*a*, and an internal chamber 92 that extends axially along axis 105 from upper end 90*a* toward lower end 90*b*. The chamber 92 is open at the upper end 90*a* and closed at the lower end 90*b* so that upper end 90*a* may also be referred to herein as an open end 90*a* and the lower end 90*b* may also be referred to herein as a closed end 90*b*.

The upper end 90*a* of sand catcher 90 is coupled to the lower end 80*b* of inlet sub 80. In particular, the upper end 90*a* of sand catcher 90 is engaged with the lower end 80*b* of inlet sub 80 via a coupling 96. In some embodiments, coupling 96 may comprise a flange assembly, a threaded connection, or any other suitable coupling assembly. Thus, the throughbore 84 is in fluid communication with the chamber 92 of sand catcher 90 via the coupling 96 and ends 80*b*, 90*a*.

Referring still to FIG. 2, one or more marker antennas 130 (or more simply "antennas 130") are coupled to telescoping joint 120. The antennas 130 each comprise an elongate member that extends axially upward from cap 124 of telescoping joint 120. Antennas 130 comprise a first or upper end 130*a* and a second or lower end 130*b* spaced from the upper end 130*a*. The lower end 130*b* coupled to the cap 124 so that the upper end 130*a* is projected axially away from lower end 130*b* and cap 124 with respect to axis 105. In some embodiments, lower end 130*b* is welded to cap 124, but any suitable coupling assembly or technique may be used in various embodiments.

In some embodiments, the antennas 130 may comprise circumferential sections or segments of tubular pipe (e.g., such as quarter pipe or similar). In some embodiments, a plurality of antennas 130 are coupled to cap 124 such that the plurality of antennas 130 are circumferentially spaced about axis 105 (e.g., uniformly-circumferentially spaced). In some embodiments, the antennas 130 are entirely or partially comprised of a metallic material—such as a ferromagnetic material (e.g., iron, steel, etc.). In some embodiments, the upper end 130*a* of antennas 130 may comprise a metallic component or material, and the other portions of antennas 130 (e.g., extending axially from upper end 130*a* to lower end 130*b*) may comprise a non-metallic and/or a non-magnetic material (e.g., a polymer, resin, etc.).

Referring still to FIG. 2, initially during operation of sand catcher 90, the chamber 92 of sand catcher 90 is empty or nearly empty so that the biasing member 72 may bias the housing 122 of telescoping joint 120, inlet sub 80, and sand catcher 90 upward within wellbore 12 along axis 105 relative to landing sub 60. Because the antennas 130 are coupled to the cap 124 of housing 122 as previously described, the antennas 130 may also be biased upward within wellbore 12 along with housing 122. As formation fluids 40 are produced from formation 6, the formation fluids 40 enter the throughbore 84 of inlet sub 80 via inlet ports 82. Thereafter, particulates 42 that are suspended within the formation fluids 40 settle vertically (relative to the direction of gravity) downward under the force of gravity into the chamber 92 of the sand catcher 90 while the relatively lighter formation fluids 40 proceed upward into the throughbore 64 of landing sub 60 and then through downhole pumping assembly 22 and production string 20 to the surface (e.g., surface 4 shown in FIG. 1).

Figure 3:
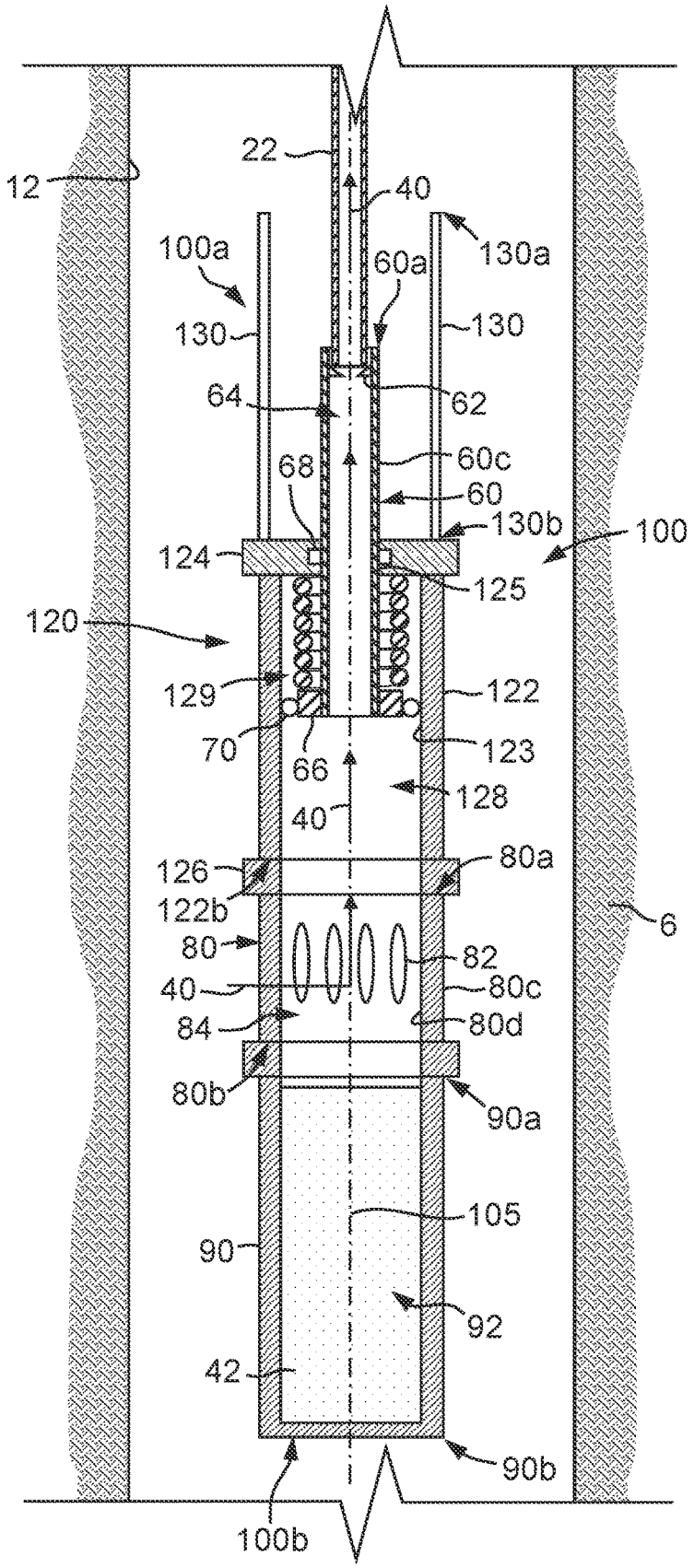

Referring now to FIG. 3, as the chamber 92 fills with collected particulates separated from the production fluids within the inlet sub 80, the weight of sand catcher 90 (and thus also the combined weight of the housing 122, inlet sub 80, and sand catcher 90) gradually increases. The increased weight of the sand catcher 90 causes the housing 122, inlet sub 80, and sand catcher 90 move axially downward within wellbore 12 along axis 105 again the axial bias exerted by the biasing member 72. As a result, cap 124 is shifted axially downward toward the shoulder 66 so that the biasing member 72 is axially compressed within the annular portion 129, and the axial length of telescoping joint 120 (e.g., from upper end 60*a* of landing sub 60 to lower end 122*b* of housing 122) is increased. As a result, as the volume of particulates captured within the chamber 92 of sand catcher 90 increases, the telescoping joint 120 axially translates downhole along landing sub 60 to allow the inlet sub 80 and sand catcher 90 to also shift or translate axially downward along axis 105.

Without being limited to this or any other theory, the axial translation of the telescoping joint 120 may be detected or measured within the wellbore 12 so as to determine the number of particulates 42 that are stored or captured within the chamber 92. For instance, in some embodiments, the axial position of the antennas 130 (e.g., such as the axial position of antennas 130 relative to landing sub 60 or some other feature that is fixed in position along the wellbore 12) may be detected to determine an axial translation of the telescoping joint 120 and thus also a fill level of the chamber 92 of sand catcher 90.

Figure 4:
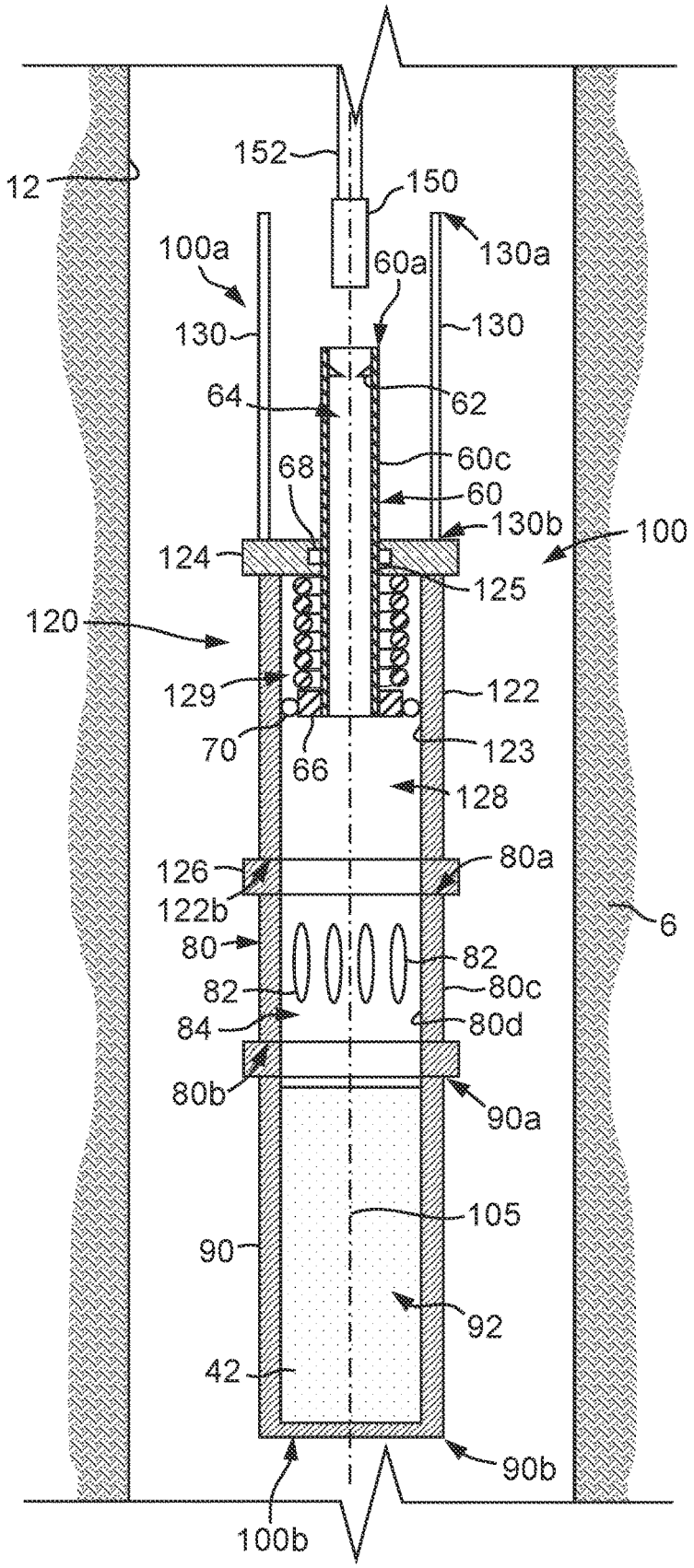
FIG. 4 is a side, cross-sectional view of the production inlet assembly of FIGS. 2 and 3 and a downhole detection device inserted within the wellbore according to some embodiments.

Referring now generally to FIGS. 1 and 4, in some embodiments, the fill level of the chamber 92 in sand catcher 90 may be determined as part of a workover operation to repair, replace, and/or service the downhole pumping assembly 22. For instance, during this process, the production string 20 and downhole pumping assembly 22 may be pulled to the surface 4, so that these components may be repaired, serviced, and/or replaced. Specifically, in an embodiment, the downhole pumping assembly 22 is unseated from landing structure 62 within landing sub 60 and pulled to the surface 4, thereby leaving the production inlet assembly 100 installed within the wellbore 12. Thereafter, a suitable downhole detection device 150 may be lowered into wellbore 12 from surface 4 so as to detect or determine the axial translation of the telescoping joint 120 of production inlet assembly 100. Specifically, in some embodiments, the downhole detection device 150 may detect the axial position (e.g., depth) of the antennas 130 to thereby decide as to the number of particulates 42 within the chamber 92 of sand catcher 90. The downhole detection device 150 may be inserted within wellbore 12 via an elongate umbilical 152 which may comprise an elongate tubular string, wireline, slickline, e-line, coiled, tubing, etc.

In some embodiments, the downhole detection device 150 may comprise a casing collar locator (CCL) that includes one or more magnets (e.g., permanent magnets, electromagnets, etc.). During operations, the magnets within the downhole detection device 150 create a magnetic field surrounding downhole detection device 150 and which is altered or perturbed by the presence of a ferromagnetic (e.g., metallic) material. Thus, when the downhole detection device 150 is lowered to the depth of the antennas 130 (e.g., a depth of the upper ends 130*a* of antenna 130), the ferromagnetic material of the antennas 130 may alter the magnetic field emitted by the magnets within device 150 so that the depth of the antennas 130 may be detected. In some embodiments, the depth of antennas 130 may be determined based on the length of umbilical that has been inserted within wellbore 12 when the downhole detection device 150 detects the presence of antennas 130. The detected depth may be compared against an initial depth of antennas 130 which may be detected or measured using the downhole detection device 150 (or another suitable downhole detection device) in a similar manner to that described above. The initial depth may be detected at a time when it is known that no particulates were stored within chamber 92 (e.g., such as when production inlet assembly 100 is initially installed within wellbore 12), and the difference between the initial depth and the later detected depth during the workover operation (after withdrawal of the downhole pumping assembly 22) may allow an operator to determine the axial translation of telescoping joint 120. In some embodiments, the downhole detection device 150 may detect the axial translation of telescoping joint 120 by detecting the axial depth of the antennas 130 as previously described above, and then also detecting the axial depth of the upper end 60*a* of landing sub 60 which is positioned at a fixed depth within wellbore 12 as previously described. For instance, as the downhole detection device 150 is progressed downhole past the antennas 130, the magnetic field emitted by the downhole detection device 150 is further perturbed is brought within a sufficient proximity of landing sub 60, so that the depth of upper end 60*a* may be detected. Once detected, the difference between the depths of the antennas 130 and upper end 60*a* may then be used to determine the axial translation of telescoping joint 120 and ultimately the fill level of chamber 92 in sand catcher 90.

Regardless, once the axial translation of telescoping joint 120 is determined, the well operator may calculate, estimate, or otherwise determine the number of particulates 42 within the chamber 92 (e.g., as a fill percentage or fraction of the total volume within chamber 92). In some embodiments, the axial compression of the biasing member 72, the axial translation of the telescoping joint 120, and/or the differences in depths between the antennas 130 (e.g., the upper ends 130*a* of antennas 130) and the upper end 60*a* of inlet sub 80 may be mathematically related (e.g., via formula, model, look-up table, etc.) to the number of particulates contained within chamber 92.

If the determined fill level of chamber 92 is sufficiently high (e.g., above a threshold), the well operator may then proceed to pull the production inlet assembly 100 to the surface 4 to empty chamber 92 as part of the workover operation. However, if the fill level of chamber 92 is low (e.g., below a threshold) then the well operator may decide to avoid the time and expense of pulling the production inlet assembly 100 to surface 4 during the workover operation.

Figure 5:
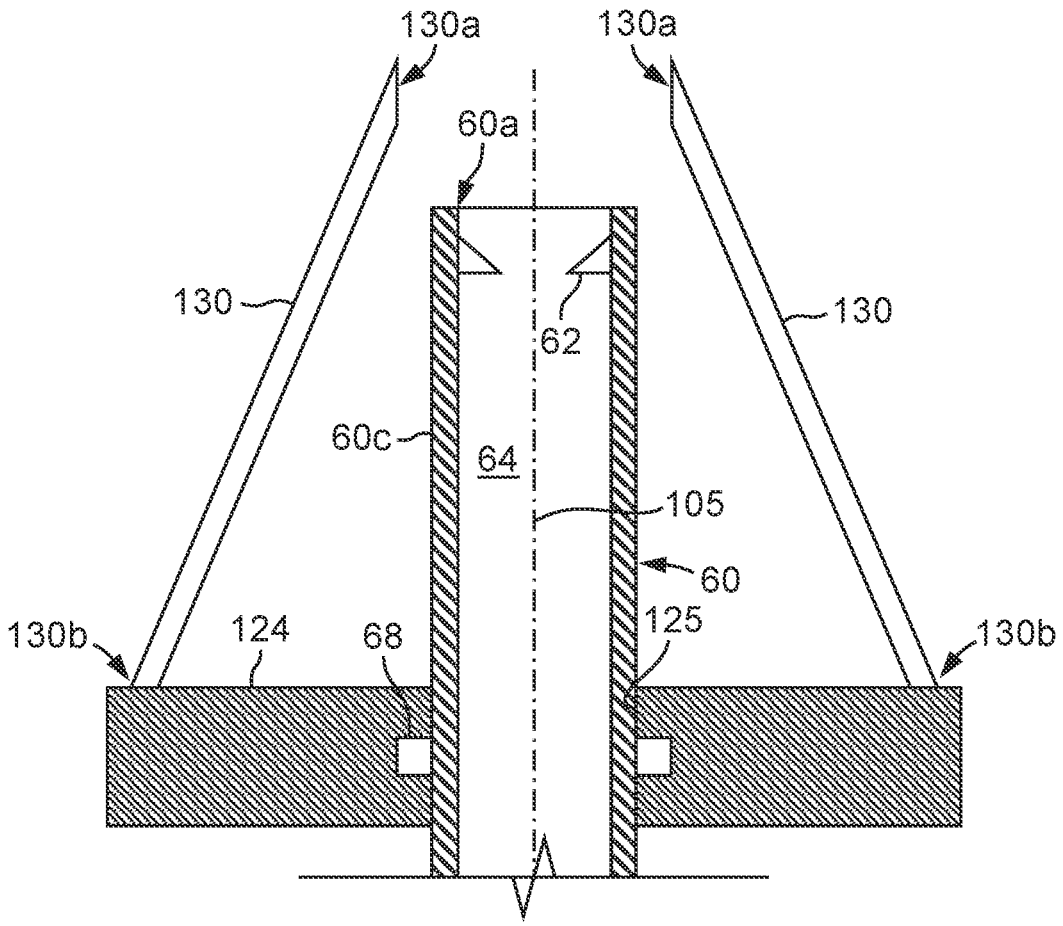
FIG. 5 is an enlarged, side cross-sectional view of the antennas of the production inlet assembly of FIG. 2 according to some embodiments.

Referring now to FIG. 5, in some embodiments, the antennas 130 may be angled or projected radially inward toward axis 105 and landing sub 60 whereby antennas 130 extend at a non-zero angle (e.g., an acute angle) relative to axis 105. For instance, in some embodiments, the antennas 130 may be angled radially inward such that the upper end 130*a* of each antenna 130 is radially closer to axis 105 than the lower end 130*b* and the antennas 130 are non-parallel with the axis 105. Without being limited to this or any other theory, angling or shifting the upper ends 130*a* of antennas 130 radially inward toward axis 105 may bring the antennas 130 (e.g., upper end 130*a*) into greater physical proximity with the downhole detection device 150 (FIG. 4), so that the downhole detection device 150 may more accurately determine the depth of antennas 130 during operations. In addition, angling the antennas 130 radially inward as shown in FIG. 5 may also prevent antennas 130 from snagging or engaging with obstructions or components (e.g., a blow out preventer) when pulling the production inlet assembly 100 to the surface 4 (FIG. 1).

While some embodiments disclosed herein include antennas (e.g., antennas 130) that may be detected by a suitable downhole detection device (e.g., downhole detection device 150) so as to determine the axial translation of a telescoping joint (e.g., telescoping joint 120*a*) and thus ultimately a fill level of a sand catcher (sand catcher 90), other detection methods and systems may be used in other embodiments. For instance, in some embodiments, suitable emitters (e.g., radioactive tags, radio frequency identification (RFID) tags, etc.) may be coupled to production inlet assembly 100 (e.g., telescoping joint 120, antennas 130, landing sub 60, etc.) that may output a signal (e.g., radiation, an RF signal, etc.) that may be detected by a suitable downhole detection device 150 to thereby determine the axial translation of telescoping joint 120 and fill level of the sand catcher 90 as previously described.

In some embodiments, a suitable signal emission system may be installed within the wellbore 12 that is configured to output a detectable signal (e.g., radio frequency (RF), acoustic, optical, infrared, electrical, etc.) in response to telescoping joint 120 axially translating beyond a threshold (e.g., which might correspond with chamber 92 of sand catcher 90 reaching a maximum capacity or a threshold capacity). The signal emission system may be activated (e.g., to output a suitable signal) by engaging a switch or other suitable mechanism when telescoping joint 120 axially translates via the weight of particulates within chamber 92 as previously described. The output signal from the signal emission system may be wired, wireless, or some combination thereof. In addition, in some embodiments, the signal output by the signal emission system may be detected at (or proximate to) the surface 4 via suitable devices, systems, and apparatus.

The embodiments disclosed herein include production inlet assemblies that allow a well operator to determine a fill level of a downhole sand catcher without pulling the sand catcher to the surface. Therefore, through use of the embodiments disclosed herein, a wellbore operator may avoid the unnecessary expense of pulling an insufficiently full sand catcher system to the surface during a workover operation.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A production inlet assembly for use within a subterranean wellbore, the wellbore including a central axis and the production inlet assembly comprising:

a landing sub that affixable within the wellbore;

a sand catcher suspendable from the landing sub within the subterranean wellbore whereby the sand catcher is permitted to travel axially through the wellbore, the sand catcher including a chamber that is configured to receive particulates separated from formation fluids that enter the production inlet assembly; and a telescoping joint coupled between the landing sub and the sand catcher, wherein the telescoping joint is permitted to translate axially along the landing sub.

2. The production inlet assembly of claim 1, further comprising a biasing member coupled between the landing sub and the telescoping joint, wherein the biasing member biases the telescoping joint axially uphole relative to the landing sub.

3. The production inlet assembly of claim 2, wherein the telescoping joint comprises:

a body;

a cap positioned at an upper end of the body; and a cavity defined within the body extending axially from a lower end of the body to the cap;

wherein the landing sub includes a cylindrical member that extends axially through a port in the cap.

4. The production inlet assembly of claim 3, wherein the landing sub includes an annular shoulder positioned within the cavity, and wherein the biasing member is positioned axially between the cap and the shoulder within the cavity.

5. The production inlet assembly of claim 4, wherein the biasing member comprises a compressible foam.

6. The production inlet assembly of claim 1, further comprising a marker antenna coupled to the telescoping joint so that the marker antenna is configured to translate with the telescoping joint relative to the landing sub, wherein the marker antenna extends axially uphole of the telescoping joint.

7. The production inlet assembly of claim 6, wherein the marker antenna comprises a ferromagnetic material.

8. The production inlet assembly of claim 1, further comprising a biasing member coupled between the landing sub and the telescoping joint, wherein the biasing member biases the telescoping joint axially uphole relative to the landing sub.

9. The production inlet assembly of claim 8, wherein the telescoping joint comprises:

a body;

a cap positioned at an upper end of the body; and a cavity defined within the body extending axially from a lower end of the body to the cap;

wherein the landing sub includes a cylindrical member that extends axially through a port in the cap.

10. The production inlet assembly of claim 9, wherein the landing sub includes an annular shoulder positioned within the cavity, and wherein the biasing member is positioned axially between the cap and the shoulder within the cavity.

11. The production inlet assembly of claim 10, wherein the biasing member comprises a compressible foam.

12. A production inlet assembly for use within a subterranean wellbore, the wellbore including a central axis and the production inlet assembly comprising:

a landing sub that affixable within the wellbore;

a sand catcher including a chamber that is configured to receive particulates separated from formation fluids that enter the production inlet assembly;

a telescoping joint coupled between the landing sub and the sand catcher, wherein the telescoping joint is permitted to translate axially along the landing sub; and a marker antenna coupled to the telescoping joint so that the marker antenna is configured to translate with the telescoping joint relative to the landing sub, wherein the marker antenna extends axially uphole of the telescoping joint.

13. The production inlet assembly of claim 12, wherein the marker antenna comprises a ferromagnetic material.

14. A production inlet assembly for use within a subterranean wellbore, the wellbore including a central axis and the production inlet assembly comprising:

a landing sub that affixable within the wellbore;

a sand catcher including a chamber that is configured to receive particulates separated from formation fluids that enter the production inlet assembly;

a telescoping joint coupled between the landing sub and the sand catcher, wherein the telescoping joint is permitted to translate axially along the landing sub; and a biasing member coupled between the landing sub and the telescoping joint, wherein the biasing member biases the telescoping joint axially uphole relative to the landing sub while permitting the telescoping joint to translate axially along the landing sub.

15. The production inlet assembly of claim 14, wherein the telescoping joint comprises:

a body;

a cap positioned at an upper end of the body; and a cavity defined within the body extending axially from a lower end of the body to the cap;

wherein the landing sub includes a cylindrical member that extends axially through a port in the cap.

16. The production inlet assembly of claim 15, wherein the landing sub includes an annular shoulder positioned within the cavity, and wherein the biasing member is positioned axially between the cap and the shoulder within the cavity.

17. The production inlet assembly of claim 16, wherein the biasing member comprises a compressible foam.

18. The production inlet assembly of claim 14, further comprising a marker antenna coupled to the telescoping joint so that the marker antenna is configured to translate with the telescoping joint relative to the landing sub, wherein the marker antenna extends axially uphole of the telescoping joint.

19. The production inlet assembly of claim 18, wherein the marker antenna comprises a ferromagnetic material.

* * * * *